United States Patent [19]

Mori

[11] Patent Number: 4,657,195

[45] Date of Patent: Apr. 14, 1987

[54] TRAVERSE MOTION

[75] Inventor: Shigeki Mori, Ohtsu, Japan

[73] Assignee: Murata Kikai Kabushiki Kaisha, Kyoto, Japan

[21] Appl. No.: 793,294

[22] Filed: Oct. 31, 1985

[30] Foreign Application Priority Data

Nov. 6, 1984 [JP] Japan ..... 59-233433

[51] Int. Cl.[4] ..... B65H 54/30

[52] U.S. Cl. ..... 242/43 R; 242/158.3; 242/158.5

[58] Field of Search ..... 242/43 R, 158.3, 158.5; 184/6.12, 6.14, 6.26, 6.28

[56] References Cited

U.S. PATENT DOCUMENTS

| | | | |
|---|---|---|---|
| 3,373,949 | 3/1968 | Swallow | 242/43 R |
| 3,612,428 | 10/1971 | Halske | 242/43 R X |
| 3,968,939 | 7/1976 | Bense | 242/43 R |
| 3,984,061 | 10/1976 | Schreiber | 242/43 R |
| 4,365,765 | 12/1982 | Schneeberger et al. | 242/43 R |

*Primary Examiner*—Stanley N. Gilreath

*Attorney, Agent, or Firm*—Barnes, Kisselle, Raisch, Choate, Whittemore & Hulbert

[57] ABSTRACT

A traverse motion for a winder which comprises a traverse drum having a spiral groove formed in the circumference thereof; a traverse guide which moves along the spiral groove, guide rails for controlling the movement of the traverse guide, a drum case covering the traverse drum, and a lubricating member fixed to the drum case so as to spray oil mist against the traverse drum.

4 Claims, 13 Drawing Figures

2
3
3a
3b
3c
5
6
11
A
E
VIa
VIb
VIc

TRAVERSE MOTION

FIELD OF THE INVENTION AND RELATED ART STATEMENT

The present invention relates to a textile machine and, more specifically to a traverse motion for a winder.

On a winder, a continuously delivered yarn is wound up on a bobbin as it is traversed by a traverse motion.

There has been proposed a traverse motion comprising a traverse drum having a spiral groove formed in the circumference thereof, a traverse guide which moves along the spiral groove for guiding a yarn, and a guide rail for guiding the traverse guide. The guide rail restricts the movement of the traverse guide only to movement parallel to the axis of the traverse drum. In such a traverse motion, when the traverse drum is rotated, the traverse guide moves along the spiral groove of the traverse drum under the control of the guide rail for reciprocation in parallel to the axis of the traverse drum within a winding range. The traverse guide is a consumable member, which is replaced with a new one when the same is worn to an extent where the traverse guide is unable to move normally due to abrasion caused by sliding contact with the guide rail or the spiral groove of the traverse drum. In replacing a worn traverse guide with a new one, a lubricant, such as a grease or an oil, is applied to the traverse drum to reduce friction between the traverse guide and the traverse drum.

The above-mentioned traverse motion has the following drawbacks. First, the traverse guide needs to be changed frequently. In addition to troublesome work for changing the traverse guide, the winder needs to be stopped to interrupt winding operation during the traverse guide changing work, which deteriorates the operating efficiency of the winder remarkably. Secondly, the abraded particles of the traverse guide accumulate within the spiral groove. Accordingly, irregularity formed in the spiral groove by the abraded particles hinders the smooth movement of the traverse guide or accelerates the abrasion of the new traverse guide.

These two drawbacks are considered to be due to the following causes. First, the most part of the lubricant applied to the traverse drum when the traverse guide is changed is caused to fly apart from the traverse drum by centrifugal force soon after the traverse drum has been started. Secondly, the heat of friction generated in the traverse guide tends to accelerate abrasion. Thirdly, part of the lubricant applied to the traverse drum in changing the traverse guide and remaining on the traverse drum is deteriorated within a short period of operation, and the traverse drum and the traverse guide are operated for a long time under ineffective lubrication condition.

Furthermore, the above-mentioned problems become more significant with the increase of the traverse speed, which has been the most serious problem in high-speed winding operation.

OBJECT AND SUMMARY OF THE INVENTION

It is an object of the present invention to provide a traverse motion in which lubricant may be supplied to the contact surfaces of the spiral groove of the traverse drum and a traverse guide during the rotation of the traverse drum.

The traverse motion of the present invention is provided with lubricating members fixed to a drum case covering the traverse drum to spray oil mists to the traverse drum. The traverse motion comprises a traverse drum having a spiral groove formed in the circumference thereof, a traverse guide which move along the spiral groove, guide rail for controlling the movement of the traverse guide, a drum covering the traverse drum, and lubricating members fixed to the drum case so as to spray oil mist against the traverse drum.

DETAILED DESCRIPTION OF PREFERRED EMBODIMENTS

Figure 9:
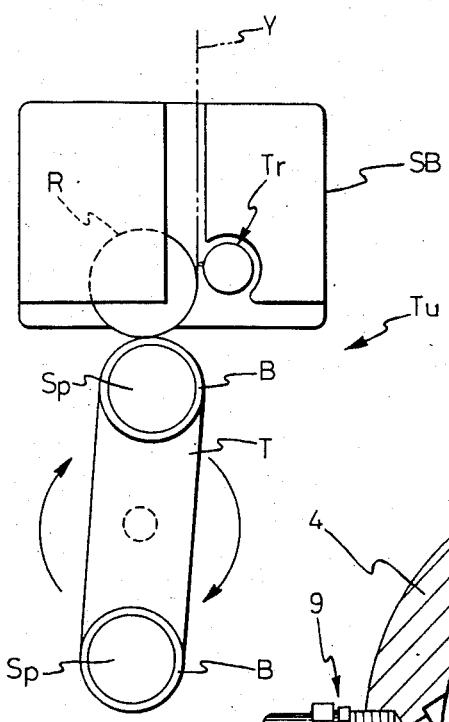
FIG. 9 is a schematic front elevation of a takeup unit, by way of example, to which the traverse motion of the present invention is applied.

A traverse motion of the present invention is applied to a take-up unit Tu, as illustrated in FIG. 9, for winding up a filament yarn Y continuously fed from a melt spinning machine on a bobbin B. This take-up unit Tu is of the turret type, in which bobbins B mounted on two bobbin holding spindles Sp attached to a turret T, respectively, are brought alternately to the winding position. At the winding position, the bobbin B is continuously in contact with a roller R supported on a vertically movable slide box SB so that a fixed contact pressure is applied continuously to the surface of the yarn layer formed on the bobbin B. The bobbin B is rotated directly by the rotation of the bobbin holding spindle Sp or indirectly by the rotation of the roller R. Indicated at Tr in FIG. 9 is a traverse motion of the present invention. The traverse motion Tr is disposed within the slide box SB for traversing the yarn Y.

Traverse motions embodying the present invention will be described hereinafter with reference to the accompanying drawings.

Figure 1:
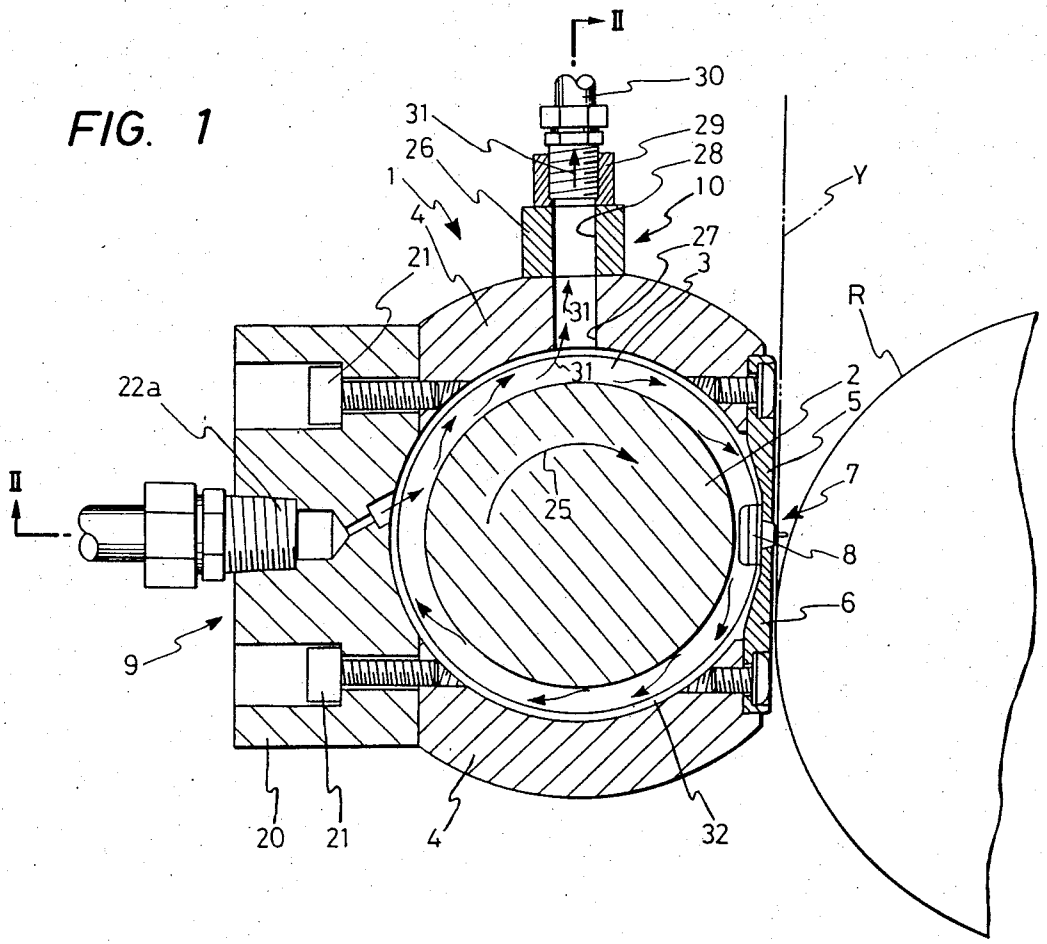
FIG. 1 is a vertical sectional front elevation of a traverse motion, in a first embodiment, according to the present invention.
Figure 2:
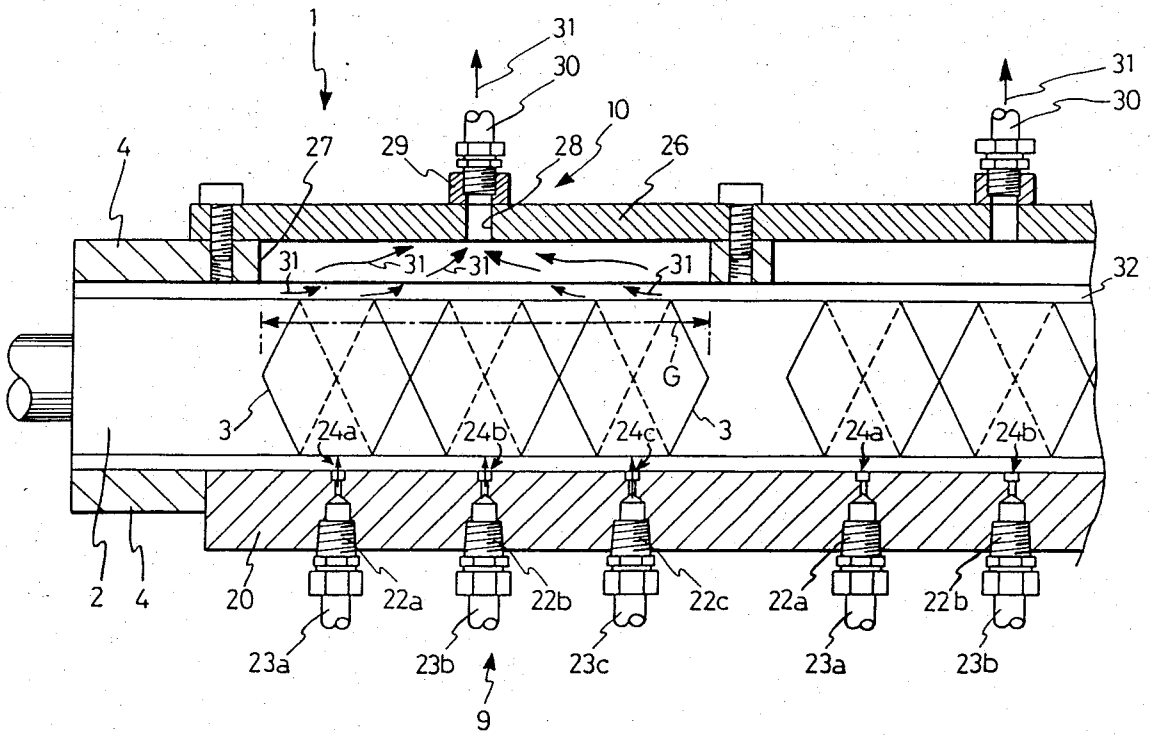
FIG. 2 is a sectional view taken along line II—II of FIG. 1.
Figure 3A:
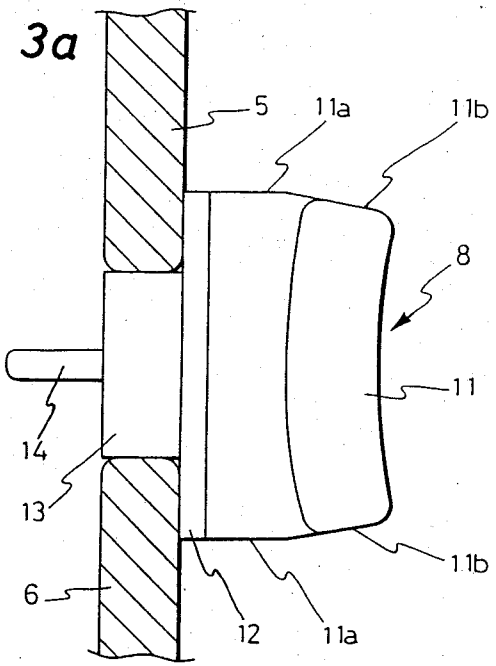
FIG. 3*a* is an enlarged side elevation of a traverse guide employed in the first embodiment.
Figure 3B:
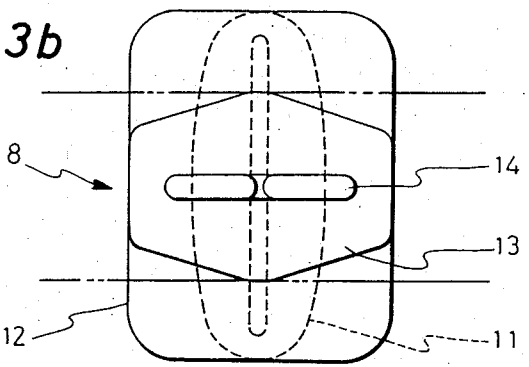
FIG. 3*b* is a plan view of the traverse guide of FIG. 3*a;*
Figure 3C:
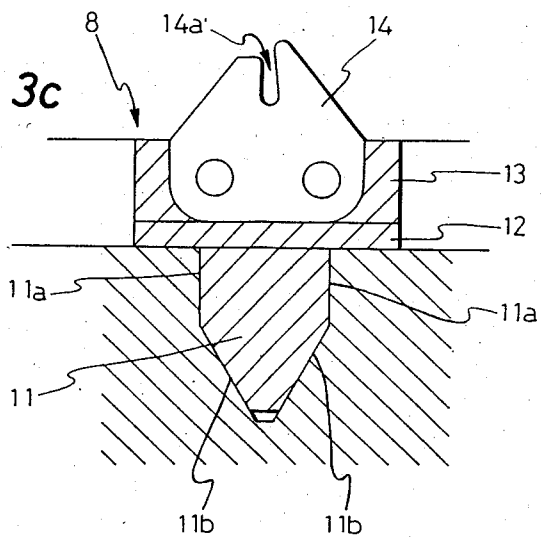
FIG. 3*c* is a front elevation of the traverse guide of FIG. 3*a;*

FIG. 1 is a vertical sectional front elevation of a traverse motion 1, in a first embodiment, according to the present invention, and FIG. 2 is a sectional view taken along line II—II of FIG. 1. The traverse motion 1 comprises a traverse drum 2, a spiral groove 3 formed in the traverse drum 2, a drum case 4, guide rails 5 and 6 screwed to the drum case 4, a guide groove 7 defined by the two guide rails 5 and 6 so as to extend in parallel to the axis of the traverse drum 2, a traverse guide 8, a lubricating unit 9, and a draining unit 10. The constitution and functions of those components will be described in detail afterward. As illustrated by enlarged views in FIGS. 3*a*, 3*b* and 3*c*, the traverse guide 8 has a shoe 11 which moves along the spiral groove 3, the shoe 11 fixed to a base 12, and a yarn guide holder 13 fixed to the upper face of the base 12. FIG. 3*a* is an enlarged side elevation of the traverse guide 8, FIG. 3*b* is a plan view of the same, and FIG. 3*c* is a front elevation of the same. The shoe 11 has vertical facets 11*a* and inclined facets 11*b* as shown in FIGS. 3*a* and 3*c*. The shoe 11, the base 12 and the yarn guide holder 13 may be formed of a highly abrasion-resistant and tough resin having a small specific gravity, such as nylon, in a lightweight integral body. A yarn guide 14 having a substantially U-shaped yarn guide slot 14*a* formed in the central portion of the upper surface thereof is provided on the yarn guide holder 13 so as to project from the latter.

Figures 4, 5, 6A, 6B, 6C:
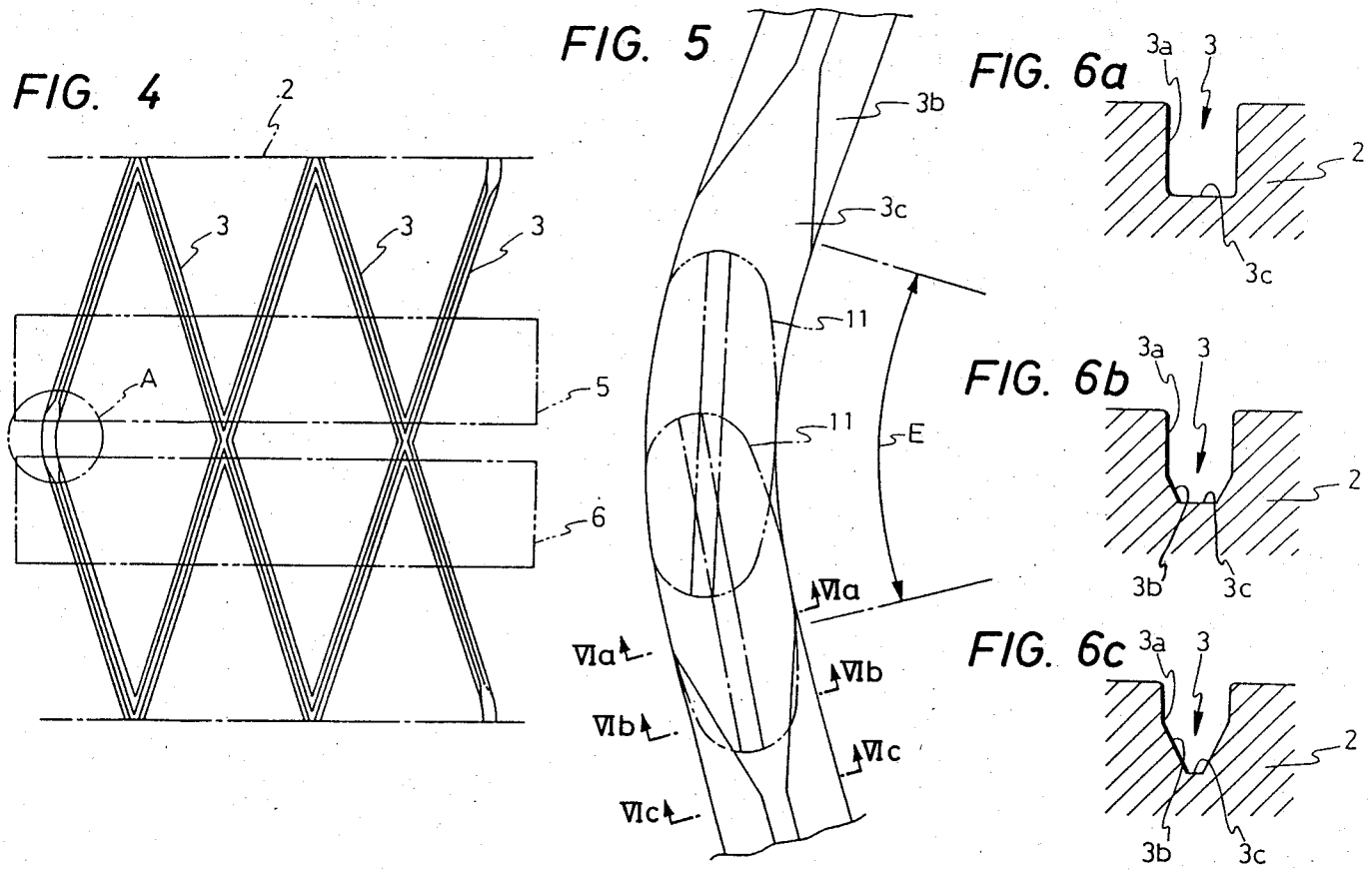
FIG. 4 is a view showing the development of a traverse drum.
FIG. 5 is an enlarged view of a portion A of FIG. 4.
FIG. 6*a* is a sectional view taken along line VIa—VIa of FIG. 5.
FIG. 6*b* is a sectional view taken along line VIb—VIb of FIG. 5.
FIG. 6*c* is a sectional view taken along line VIc—VIc of FIG. 5.

The spiral groove 3 of the traverse drum 2 will be described hereinafter with reference to FIGS. 4 to 6*c*. The linear sections of the spiral groove 3 in the development of the traverse drum illustrated in FIG. 4, have a shape fitting the shoe 11 of the traverse guide 8 so that the shoe 11 is slidable without vibration along the linear sections; that is, the spiral groove 3 in the linear sections has vertical surfaces 3*a*, inclined surfaces 3*b* and a bottom surface 3*c*. In the return section A, where the traverse guide 8 changes the direction of movement, the inclined surfaces 3*b* are reduced gradually. In a range E, the spiral groove 3 has a rectangular cross section to facilitate the sliding movement of the traverse guide 8 in the return section A. FIGS. 6*a*, 6*b* and 6*c* are sectional views of the spiral groove 3 taken along lines VIa—VIa, VIb—VIb, and VIc—VIc of FIG. 5, respectively.

The lubricating unit 9 and the draining unit 10 will be described hereinafter with reference to FIGS. 1 and 2.

A lubricating base plate 20 extending practically over the entire length of the traverse drum 2 is fixed to the drum case 4 with screws 21. In FIG. 2, a range G corresponds to the range of reciprocation of one traverse guide 8 for one bobbin. Accordingly, when four bobbins are mounted on the bobbin holding spindle Sp, for instance, three more such ranges G are arranged side by side on the right-hand side, as viewed in FIG. 2, of the range G illustrated in FIG. 2. Three lubricating nozzles 22*a*, 22*b* and 22*c* are screwed in the lubricating base plate 20 at equal intervals for each range G. The lubricating nozzles 22*a*, 22*b* and 22*c* are connected by lubricating tubes 23*a*, 23*b* and 23*c*, respectively, to an oil tank, not shown. The oil mist formed in the oil tank is supplied through the lubricating tubes 23*a*, 23*b* and 23*c* to the lubricating nozzles 22*a*, 22*b* and 22*c*, and then is sprayed through the nozzle holes 24*a*, 24*b* and 24*c*, respectively, against the traverse drum 2. The angle of the axes of the nozzle holes 24*a*, 24*b* and 24*c* with respect to the traverse drum 2 is decided so that the axes are tangential to the traverse drum 2. The oil mist is sprayed through the nozzle holes 24*a*, 24*b* and 24*c* practically in the same direction as that of rotation of the traverse drum 2 indicated by an arrow 25 in FIG. 1.

A draining base plate 26 extending substantially over the entire length of the traverse drum 2 is screwed to the drum case 4. A slot 27 is formed in parallel to the axis of the traverse drum 2 in the drum case 4 in a portion in contact with the draining base plate 26 in a range corresponding to the range G. A hole 28 is formed in the draining base plate 26 at a position corresponding to the middle position of the slot 27. A cylindrical connecting member 29 having an inside diameter practically same as the diameter of the hole 28 is fixed to the draining base plate 26. One end of a drain pipe 30 is screwed in the connecting member 29, while the other end of the same is connected to a pneumatic source and a drain tank, which are not shown. When the pneumatic source is operated, a suction air flow indicated by arrows 31 is produced around the circumference of the traverse drum 2 and through the slot 27.

The disposition of the lubricating unit 9 and the draining unit 10 is not limited to that shown in FIG. 1, and the lubricating unit 9 and the draining unit 10 may be disposed in various manners. However, it is the optimum manner, in view of preventing excessive lubrication of the traverse guide 8 and soiling the yarn Y with the oil mist, to dispose the lubricating unit 9, the draining unit 10 and the traverse guide 8 in the order of the lubricating unit 9, the draining unit 10 and the traverse guide 8 with respect to the direction 25 of rotation of the traverse drum 2.

The manner of operation of this embodiment thus constituted will be described hereinafter.

When the traverse drum 2 is rotated, the traverse guide 8 is reciprocated by the spiral groove 3 of the traverse drum 2. The direction of movement of the traverse guide 8 is restricted only to a direction parallel to the axis of the traverse drum 2 by the guide rails 5 and 6. Accordingly, the traverse guide 8 is reciprocated by the spiral groove 3 along the guide rails 5 and 6 within the range G. The yarn guide 14 of the traverse guide 8 receives the yarn Y therethrough to traverse the yarn Y.

Figure 7:
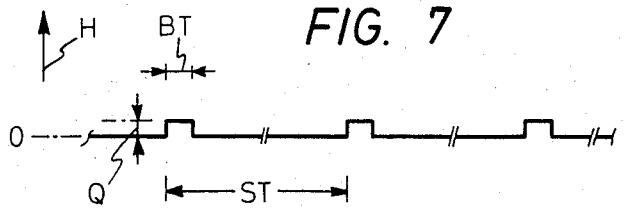
FIG. 7 is a time chart for spraying the oil mist by the lubricating nozzles.

As shown in a time chart of FIG. 7, the oil mist is sprayed intermittently by the lubricating nozzles 22*a*, 22*b* and 22*c* while the traverse guide 8 is reciprocated continuously. In FIG. 7, the axis of abscissa represents time T, while the axis of ordinate represents oil mist spraying amount H. When the ordinate is zero, the value of H is zero. Intervals BT and ST correspond to the duration of oil mist spraying operation and one cycle time of oil mist spraying operation, respectively. In this embodiment, the cycle time ST is constant regardless of time of operation of the traverse motion to simplify the description. However, it is possible to reduce the cycle time ST with time or to maintain the cycle time ST at a fixed level while the oil mist spraying amount Q is varied. The cycle time ST is a value of hour level, while the duration BT of oil mist spraying operation is a value of second or minute. The cycle time ST and the duration BT are decided appropriately in taking into consideration the operating conditions of the traverse motion.

The minute oil droplets of the oil mist thus sprayed adhere to the surface of the traverse drum 2. The oil mist is a mixture of oil droplets and air, in which the oil droplets float in the air current. Since the lubricating nozzles 22*a*, 22*b* and 22*c* are arranged at equal intervals within the range G, the entire circumference of the traverse drum 2 is lubricated uniformly. Naturally, the minute oil droplets adhere also to the inner surface of the spiral groove 3 to lubricate the constant surfaces of the spiral groove 3 and the traverse guide 8. More specifically, the contact surfaces are the vertical facets 11*a* and inclined facets 11*b* of the shoe 11 of the traverse guide 8 and the vertical surfaces 3*a* and inclined surfaces 3*b* of the spiral groove 3. If these contact surfaces are not well lubricated or lubricated with ineffective oil, namely, worn oil, the coefficient of friction between the corresponding contact surfaces increases and the abrasion of the contact surfaces is accelerated. The abrasion and the heat generated by abrasion between the contact surfaces causes the shoe 11 to wear. When the shoe 11 is worn, the traverse guide vibrates as it is reciprocated, and hence the traverse guide 8 is unable to be reciprocated smoothly. In this embodiment, the value of the cycle time ST is decided so as to supply fresh oil droplets to the contact surfaces before such problems occur. Furthermore, the air supplied together with the oil droplets takes away the heat generated by friction between the contact surfaces which reduces the abrasion of the contact surfaces.

A small amount of oil droplets that do not adhere to the surface of the traverse drum 2 float in the air current generated by the rotation of the traverse drum 2 in the direction 25 in the space 32 between the circumference of the traverse drum 2 and the drum cover 4. The floating oil droplets are sucked through the slot 27 formed in the drum case 4, and then are carried outside the traverse motion 1 through the drain pipe 30. Accordingly, excessive oil droplets do not stay within the drum case, and hence oil droplets do not adhere to the running yarn Y.

In this embodiment, the fresh oil mist is supplied intermittently to the traverse drum. Sucking the excessive oil droplets through the drain pipe 30 may be started and interrupted at appropriate timing in relation to the oil mist spraying cycle or a low suction may be produced continuously within the drum case 4 to suck out scattered oil.

The results of measurement of the life of the traverse guide of the above-mentioned traverse motion will be described briefly hereunder. The life of the traverse guide of the traverse motion of the present invention was compared with that of traverse guide of the same traverse motion operated under the same conditions, except that the oil mist was not supplied. When the yarn is wound at an ordinary winding speed (5000 m/min), the life of the traverse guide of the traverse motion of the present invention was 2 to 2.5 times that of the control. When the yarn was wound at a high winding speed (6000 m/min), the life of the traverse guide of the present invention was 2.5 to 4 times that of the control. It is apparent that this embodiment is particularly effective for highspeed yarn winding.

Figure 8:
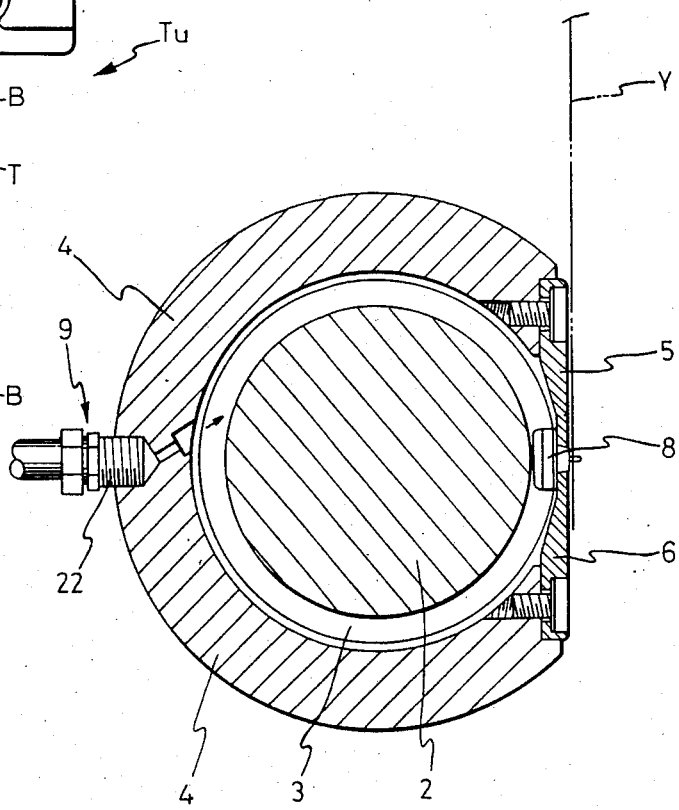
FIG. 8 is a sectional front elevation of a traverse motion, in a second embodiment, according to the present invention.

Another embodiment of the present invention will be described hereinafter. FIG. 8 is a sectional front elevation of a second embodiment of the present invention. The second embodiment differs from the first embodiment in that the traverse motion 40 has lubricating nozzles 22 screwed directly in a drum case 4 and any draining unit corresponding to the draining unit 10 of the first embodiment is not provided. The same members as those of the first embodiment are designated by the same reference characters and the description thereof will be omitted. Directly screwing the lubricating nozzles 22 in the drum case 4 requires less parts, reduces the cost and simplifies assembling work as compared with the first embodiment. Elimination of the draining unit 10 reduces the cost and simplifies assembling work, however, the oil mist spraying rate needs to be reduced to the least necessary extent to prevent soiling the yarn Y with the lubricant.

However, when a lubricant containing mineral oil as the principal component and a scouring improver as an additive is used, any trouble, such as dyeing speck, will not occur in the following process, even if the yarn is soiled more or less with the lubricant.

The oil mist may be sprayed continuously at a small rate instead of spraying the oil mist intermittently as in the first embodiment, to supply fresh oil droplets continuously.

When a traverse drum coated with a layer of tetrafluoroethylene is employed instead of a conventional iron traverse drum, the coefficient of friction between the contact surfaces of the spiral groove of the traverse drum and the traverse guide becomes smaller, and thereby the life of the traverse guide is extended.

As apparent from the foregoing description, the present invention is capable of eliminating the causes of all the problems of the conventional traverse motion, and has the following effects.

(i) The life of the traverse guide is extended, and hence the traverse guide need not be changed frequently, the frequency of interruption of operation of the takeup unit is reduced, and thereby efficient operation of the takeup unit is achieved.

(ii) Extension of the life of the traverse guide enables changing the traverse guide before the traverse guide is worn excessively and the abraded particles of the traverse guide will not accumulate in the spiral groove of the traverse drum, and thereby stable reciprocation of the traverse guide, the stable traverse of the yarn, is always ensured.

(iii) Supplying the lubricant in a mist of the lubricant enables supplying the least necessary amount of the lubricant, which achieves economical lubrication and obviates the generation of heat by stirring the lubricant.

(iv) High-speed traverse motion is possible for high-speed yarn winding operation.

What is claimed is:

1. A traverse motion comprising a traverse drum having a spiral groove formed in the circumference thereof, a traverse guide which moves along the spiral groove, guide rails for controlling the movement of the traverse guide, a drum case covering the traverse drum, and lubricating members fixed to the drum case so as to spray oil mist against the traverse drum, said lubricating members comprising a lubricating unit having a lubricating base plate extending substantially over the entire length of the traverse drum and fixed to the drum case and a plurality of lubricating nozzles secured in the lubricating base plate and connected to an oil tank where oil mist is formed, and a draining unit having a draining base plate extending substantially over the entire length of the traverse drum and fixed to the drum case, a slot formed in the drum case in a portion in contact with the draining base plate and communicating with a hole formed in the draining base plate and a pneumatic source for producing a suction air flow around the circumference of the traverse drum and through the hole and the slot.

2. A traverse motion as claimed in claim 1, wherein the angle of the axes of nozzle holes of the lubricating nozzles with respect to the traverse drum is decided so that the axes are tangential to the traverse drum.

3. A traverse motion as claimed in claim 2, wherein said nozzle holes are formed in the same direction as that of rotation of the traverse drum.

4. A traverse drum as claimed in claim 1, wherein said lubricating unit, said draining unit and said traverse guide are disposed in the order of the lubricating unit, the draining unit and the traverse guide with respect to the direction of rotation of the traverse drum.

* * * * *